US012808208B1

(12) United States Patent
Ruiz Perez et al.

(10) Patent No.: US 12,808,208 B1
(45) Date of Patent: Nov. 24, 2026

(54) PROFILE SYSTEM FOR FINISHING TILES

(71) Applicant: Guru USA, LLC, Carrollton, TX (US)

(72) Inventors: Francisco Javier Ruiz Perez, Carrollton, TX (US); Francisco Javier Ruiz Bernabeu, Carrollton, TX (US); Alejandro Sisternes Pla, Carrollton, TX (US); Iván Rubio Martinez, Carrollton, TX (US)

(73) Assignee: Guru USA, LLC, Carrollton, TX (US)

( * ) Notice: Subject to any disclaimer, the term of this patent is extended or adjusted under 35 U.S.C. 154(b) by 0 days.

(21) Appl. No.: 19/403,351

(22) Filed: Nov. 28, 2025

(51) Int. Cl.
*E04F 19/06* (2006.01)
*E04F 19/04* (2006.01)

(52) U.S. Cl.
CPC .... *E04F 19/061* (2013.01); *E04F 2019/0413* (2013.01)

(58) Field of Classification Search
CPC ..... E04F 19/061; E04F 2019/0413; E04F 19/062–068
See application file for complete search history.

(56) References Cited

U.S. PATENT DOCUMENTS 2,982,570 A * 5/1961 Lohman ..... H02G 3/0608 138/155
5,523,529 A * 6/1996 Holliday ..... H02G 3/0418 174/101
2003/0155148 A1* 8/2003 Lockard ..... H02G 3/0608 174/68.1
2003/0221388 A1* 12/2003 Benedettini ..... E04F 19/061 52/716.1
2006/0117684 A1* 6/2006 Picard ..... H02G 3/00 52/239
2018/0328027 A1* 11/2018 Singh ..... E04B 1/6803

FOREIGN PATENT DOCUMENTS

AT 509578 B1 * 5/2015 ..... G09F 15/0012
CA 2556369 A1 * 2/2008 ..... E04F 19/0436
EP 3150792 A1 * 4/2017 ..... E06B 3/26336
EP 3429040 A1 * 1/2019 ..... H02G 3/0437

* cited by examiner

*Primary Examiner* — Babajide A Demuren

(57) ABSTRACT

The invention provides a profile system for finishing tile installation that enables quick, invisible butt-joining of two elongate profile sections while matching surrounding grout width. Each profile includes a base leg that embeds in tile adhesive and a main leg with a generally "C"-shaped protrusion whose opening defines a longitudinal clipping recess that opens to the side where the base leg is. A spacer flange joins the "C"-shaped protrusion to the base leg, and an outwardly sealing wall projects from the boundary wall of the "C"-shaped protrusion to cooperate with an adjacent tile edge and form a grout groove. A separate connecting piece, preferably from an elastomeric or thermoplastic material, is pressed transversely into the clipping recesses of two abutting profiles; its ribs engage undercut grooves to create a combined form-fit and friction-lock without tools. Alternative connecting piece geometries (optionally with a lateral flange) allow on-site selection of grout-joint widths of about 1.5-5 mm while preserving a continuous metallic edge and robust anchorage.

13 Claims, 3 Drawing Sheets

PROFILE SYSTEM FOR FINISHING TILES

FIELD AND BACKGROUND OF THE INVENTION

The present invention relates to finishing elements for tile installations, and more particularly to profile systems formed by extruded elongate profiles that are mechanically joined coaxially end-to-end by a connecting piece. The invention is directed to edge-protection and decorative termination of floor or wall tiles, allowing precise alignment of adjacent profile sections, customizable grout-joint widths, and secure anchorage to the underlying substrate.

STATE OF THE ART

Tile-finishing profile systems have been marketed for decades to provide edge protection, aesthetic termination, or corner connections where tiles meet other surfaces.

One of these profile systems is shown in U.S. Pat. No. 6,591,575 B2 which discloses an extruded edging strip comprising a substrate-engaging member, a tile-engaging member, a spacing support member that defines a channel for receiving a secondary substrate, and a transition lip that provides a finished edge. Apertures in the substrate and tile-engaging members accept fasteners or adhesive, and the strip may include a wedge-shaped lead-in to ease installation. Corner connectors are inserted into a slot formed between the structural members to join adjacent strips.

Although the referred document provides edge protection and a connector slot, the profiles are joined by separate corner pieces or connectors that slide into a longitudinal slot; it does not offer a face-to-face butt joint of two profile lengths using a transverse, pressure-inserted bridge.

Another disclosure is the document US 2022/243 747 A1 which teaches a system of elongate profiles that are mechanically joined at their end faces via separate connecting pins. Each pin has two end portions: a domed, slotted clamping section that friction-fits into a circular receiving opening in the profile, and a second end portion with an annular indentation that snaps into a hole of an intermediate or end element. The pins can be plastic injection-mouldings, and two pins per joint provide anti-rotation.

The afore document focuses on cylindrical pins received in circular bores; it does not contemplate a longitudinal recess with internal grooves that receives a flat or bar-shaped bridge introduced transversely from the interior side. The disclosure is silent on creating or controlling grout-joint thickness, and the need for precise drilled openings increases manufacturing complexity.

On the other hand, widely used Schluter® profiles employ metallic extrusions with longitudinal cavities that accept slide-in connectors or are simply butt-joined with adhesive. Some variants include internal ribs or undercuts to improve mortar lock, but the profile-to-profile connection is typically achieved by sliding connectors lengthwise from the exposed face, not by a transverse clip-on bridge. Moreover, the joint-width is fixed by the extrusion itself; customisable grout-joint thickness by interchangeable bridges is absent.

In the light of the state of art, there are some unmet needs, for example a rapid, tool-free alignment of two profile lengths without sliding a connector along the visible face, or customisable joint-gap to match the surrounding tile grout thickness, selectable on site, among others.

SUMMARY OF THE INVENTION

In order to meet the needs previously discussed, the present invention provides a profile system for finishing tiles a profile system for finishing tiles that enables two elongate profile sections to be butt-joined quickly and invisibly while matching the surrounding grout width. Each profile is an extrusion of constant cross-section and comprises:

- a base leg that lies in the tile adhesive on the substrate; and
- a main leg that carries an inverted, generally "C"-shaped protrusion whose opening defines a longitudinal clipping recess opening toward or essentially parallel to the base leg.

At installation, the longitudinal ends of two profiles are placed in coaxial abutment. A separate connecting piece, preferably made from an elastomeric or thermoplastic material, is pressed transversely into the clipping recesses, its projections engaging undercut grooves so that the profiles are locked together by combined form-fit and friction without tools or fasteners.

A spacer flange integrally joins the "C"-shaped protrusion to the base leg and delimits the clipping recess, while an outwardly widening sealing wall projects from the outer wall of the "C"-shaped protrusion to create a grout groove which, together with an adjacent tile edge, can form a grout whose width can be selected about 1.5-5 mm by choosing among alternative connecting-piece geometries.

The connecting piece comprise a longitudinal groove for easier insertion in the clipping recess and/or a flange that serves as a tile stop to widening the grout.

In other optional variants the connecting piece does not comprises the longitudinal groove aforementioned.

The system therefore combines rapid, face-to-face alignment of profile lengths via a concealed clip-in connecting piece (or bridge); a robust mechanical lock achieved inside the clipping recess of the "C"-shaped protrusion; and an integrated sealing wall that predetermines grout-joint thickness and improves anchorage.

BRIEF DESCRIPTION OF THE SEVERAL VIEWS OF THE DRAWING(S)

The foregoing and other advantages and features will be more fully understood from the following detailed description of exemplary embodiments with reference to the accompanying drawings, which should be considered by way of illustration and not limitation, wherein.

DESCRIPTION OF SPECIFIC EMBODIMENTS OF THE INVENTION

In the following detailed description, numerous specific details are set forth in the form of examples to provide a thorough understanding of the relevant teachings. However, it will be apparent to those skilled in the art that the present teachings can be implemented without such details.

The invention discloses a profile system 1 comprises at least two elongate profiles 2, profiles hereinafter, of identical cross-section and a connecting piece 3. Each profile 2 can be an aluminium or stainless-steel extrusion about 2 m-2.5 m long and 1 mm-2 mm thick, although other lengths and metals/materials (or coated plastics) can be used. In the factory the extrusion is cut to length; in the field it could be trimmed to fit a tile run.

Figure 1:
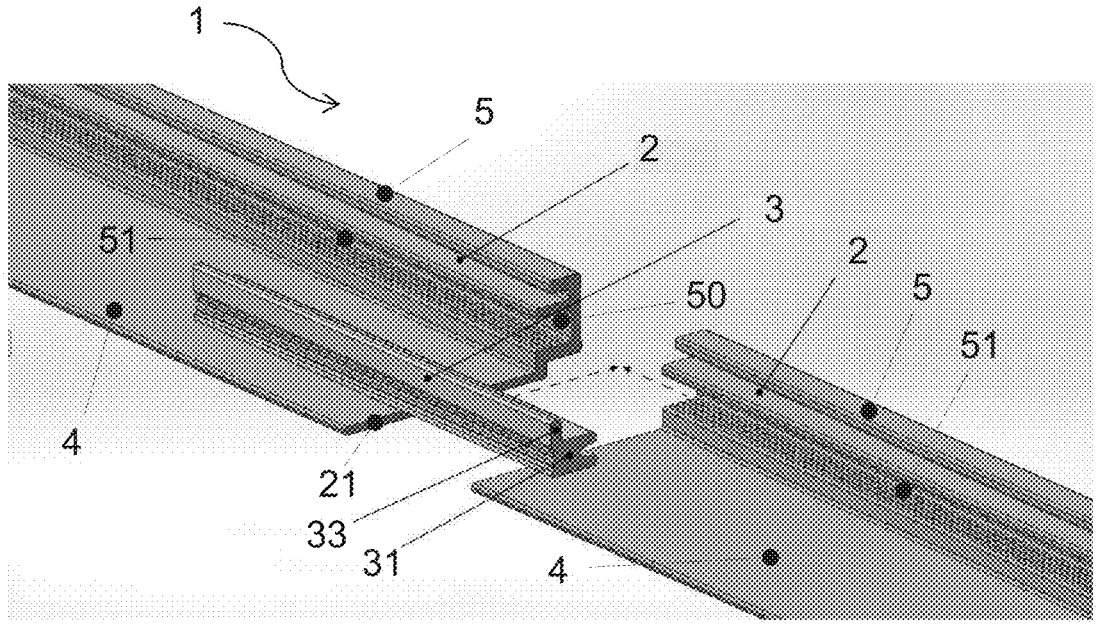
FIG. 1 is a perspective view of the profile system in a decoupled wherein the main components are shown.
Figure 2:
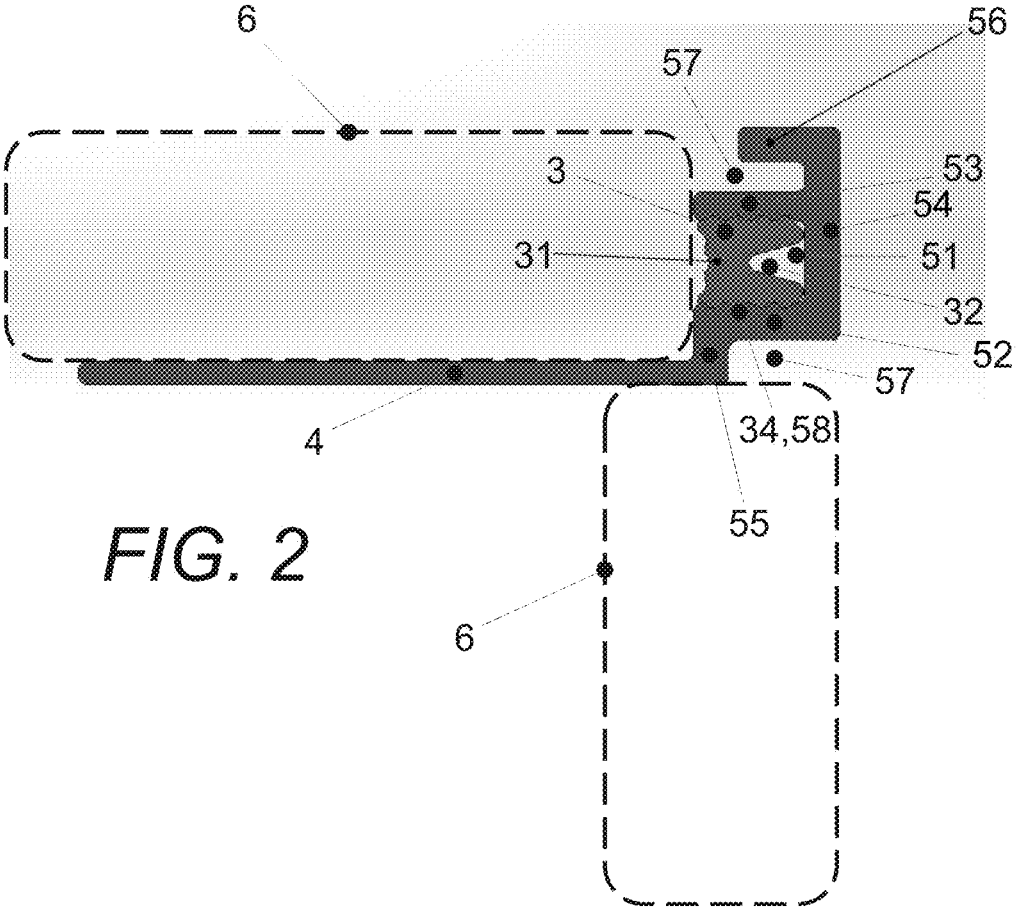
FIG. 2 is a view in cross section of the profiles and the connecting piece, of a first embodiment of the connecting piece.
Figure 3:
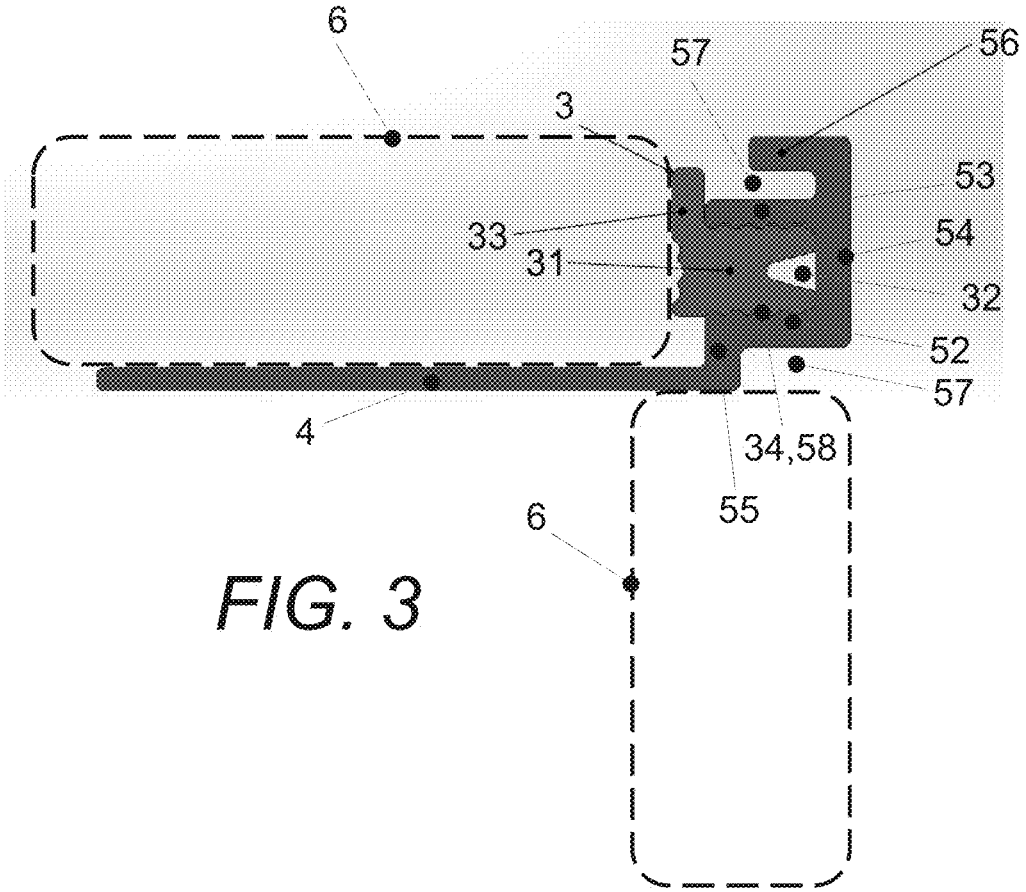
FIG. 3 is a view in cross section of the profiles and the connecting piece, of a second embodiment of the connecting piece.

In the embodiment shown in the FIGS. 1 to 3, each profile 2 has a base leg 4 lying in the mortar or adhesive bed on a substrate or base. The lower surface, which is oriented to the substrate, may carry longitudinal anchoring ribs (not shown) that improve mechanical bond and resist pull-out. Further, the base leg 4 may include cut outs (not shown) for improving the bonding to the substrate.

The profile 2 also comprise a main leg 5 rising from the base leg 4 and comprising a generally square "C"-shaped protrusion 50, whereas in another not shown embodiments, this main leg 5 can have alternative shapes apart from a vertical rising square leg (for example curved, bevelled or any other geometry). The cavity of this "C" constitutes a longitudinal clipping recess 51 that opens to the side where the base leg 4 is. The "C"-shaped protrusion 50 comprises an inner wall 52 disposed closest to the base leg 4, an outer wall 53 spaced from the base leg 4, and a boundary wall 54 generally perpendicular to the base leg 4 and integrally joining the inner 52 and outer 53 walls, thereby closing three sides of the clipping recess 51. The inner wall 52 and the outer wall 53 being essentially parallel each other and, at the same time, parallel to the base leg 4. The profile 2 comprises a spacer flange 55 extending from the inner wall 52 to the base leg 4 and defines a region where a tile 6 bears in use of the system 1.

A sealing wall 56 projects from the outer wall 53 and widens as it extends away from that wall 53, and as can be seen in FIGS. 2 and 3 together with the tile edge of the tile 6 delimiting a grout groove 57 whose width is selectable between around 1.5 mm and 5 mm. In use of the system 1, the sealing wall 56 is the visible part of the profile 2, once the tiles 6 are installed.

Internal faces of the clipping recess 51 are provided with undercut grooves 58 that cooperate with complementary ribs on the connecting piece 3 to achieve a combined form-fit and friction-fit lock.

In FIG. 2 the connecting piece 3 is realised as an elongate body 31 of elastomeric or thermoplastic material which provides limited elastic compression. A longitudinal insertion groove 32 running along one side of the body 31 briefly reduces its effective width during insertion. Once pressed into the inner faces of at least two abutting grooves 58, the body 31 re-expands so that its lateral ribs 34 snap into the grooves 58; the ends of the profiles 2 are thus coaxially butt-joined without tools, fasteners or adhesive. The exposed face of body 31 sits flush with, or slightly below, the tops of walls 52, 53 so that no part is visible in the finished installation.

FIG. 3 shows an optional variant in which the body 31 additionally carries a flange 33 that projects from the body 31 and, when the body 3 is inside the clipping recess 51, said flange 33 runs outside the clipping recess 51, being also essentially perpendicular to the body 31. The flange 33 acts as a spacer during setting and enlarges the effective grout width.

Figure 4:
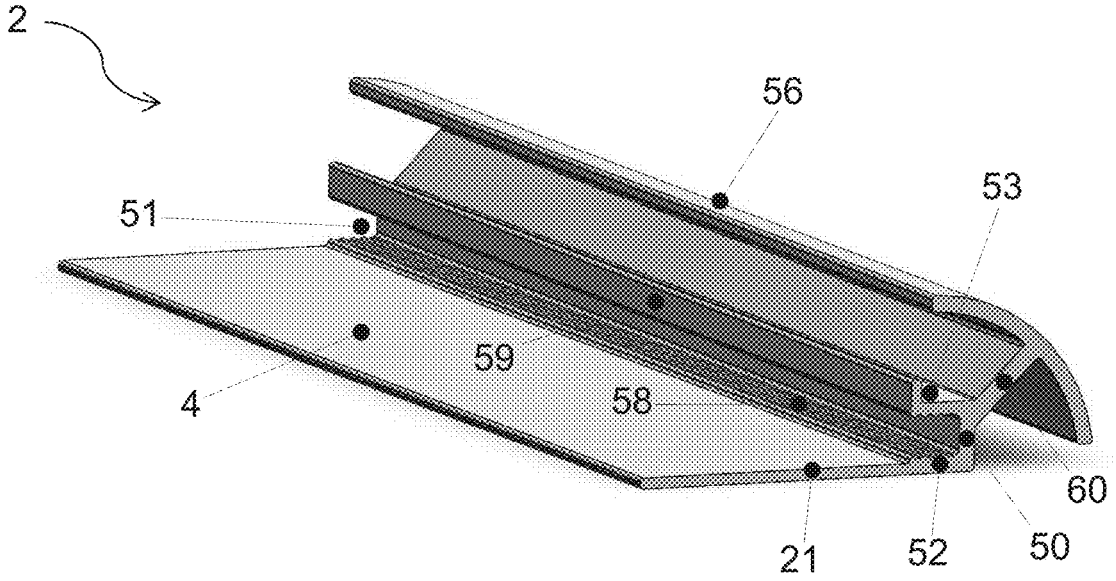
FIG. 4 is a perspective view of an alternative profile that can be used in the profile system, showing the main components of said alternative profile.
Figure 5:
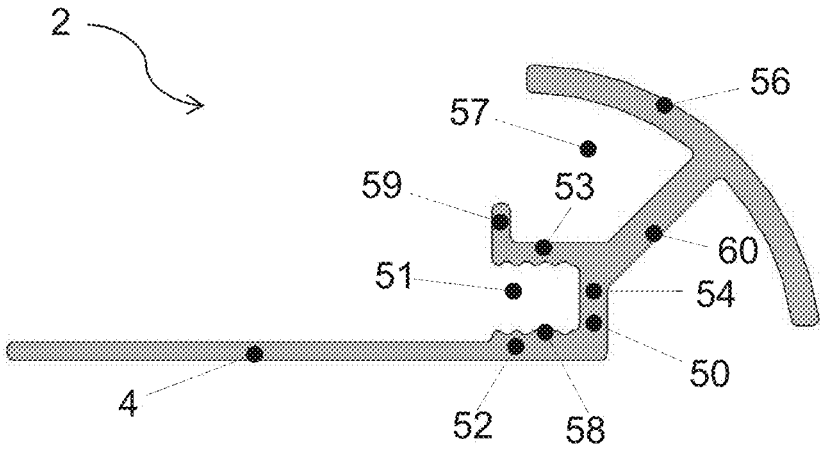
FIG. 5 is a view in cross section of the alternative profile embodiment shown in FIG. 4.

In an optional variant of the profile 4 shown in FIGS. 4 and 5, the inner wall 52 of the "C"-shaped protrusion 50 extends as a continuation of the base leg 4. In this variant, the "C"-shaped protrusion 50 further comprises an outer wall 53 spaced apart from the base leg 4, and a boundary wall 54 substantially perpendicular to the base leg 4 and integrally joining the inner 52 and outer 53 walls, thereby enclosing three sides of the clipping recess 51. The outer wall 53 is substantially parallel to the base leg 4.

Further, in this variant, the profile 2 includes an abutment flange 59 extending substantially perpendicularly from the outer wall 52, against which the tile 6 bears in use of the system 1.

As depicted in FIGS. 4 and 5, in this embodiment the sealing wall 56 is a curved wall having its concavity oriented toward the outer 53 and boundary 54 walls. From the corner where the outer 53 and boundary 54 walls meet, a connection pillar 60 projects to connect the curved sealing wall 56 with the outer 53 and boundary 54 walls. Thus, the outer wall 53, the connection pillar 60, and a region of the curved sealing wall 56 define the grout groove 57.

As in the previously described embodiment of the profile 2, in use of the system 1 the curved sealing wall 56 constitutes the visible part of the profile 2 once the tiles 6 are installed.

Additionally, in this variant of the profile 2, abutting grooves 58 are provided along the inner faces of both the inner wall 52 and the outer wall 53, such that, when the body 31 of the connecting piece 3 re-expands after insertion into the clipping recess 51, its lateral ribs 34 snap into the grooves 58.

On the other hand, the installation method comprises the steps of cut and place profiles. Two profiles 2 are cut square and placed with their ends 21 in coaxial abutment along the intended tile edge.

Then, the connecting piece 3 is located facing the clipping recess 51 in both abutting profiles and pressed transversely—in a direction perpendicular to the profile length-into the clipping recesses 51 until the ribs 34 of body 31 snap into grooves 58 of the clipping recess 3. The visible faces of the profiles 2 remain unmarred because the connecting piece 3 is inserted from the concealed, substrate side. Furthermore, many of this press-fit connecting pieces 3 can be used as a spacer to ensure the constant grout width clipping them alongside the profile.

Next, tiles 6 are set against spacer flange 55 (and, where present, against flange 33), or alternatively the abutment flange 59 while adhesive beneath the base leg 4 beds into ribs or cut outs.

After curing, grout is packed into groove 57, its thickness having been predetermined by combining sealing wall 56 and any flange 33. Excess grout is wiped flush with the tile 6 surface.

The resulting installation shows a continuous metallic edge, precise joint alignment, and a grout line whose width matches the surrounding tile field.

In alternative embodiments, instead of squared, the recess formed in protrusion that has the clipping recess 51 may be slightly trapezoidal to ease connecting piece insertion.

Alternatively, grooves 58 and the ribs 34 of body 31 may be saw-toothed, barbed or under-cut to increase pull-out strength.

Further, the sealing wall 56 can be solid or hollow, and may carry transverse perforations to enhance mortar keying.

Profiles 2 may be extruded from metal with many finishes like anodised aluminium, brushed stainless steel, powder-coated alloys in architectural colours, or any plastic material.

What is claimed is:

1. A profile system (1) for finishing tiles that comprises at least two elongate profiles (2), each having a constant cross-section along their length;

an elongated connecting piece (3) having a constant cross-section along its length configured to join the profiles (2);

wherein each elongated profile (2) comprises, viewed in cross-section, a base leg (4) configured for engaging a primary substrate or base, and a main leg (5) adjoining the base leg (4) carrying an inverted, generally "C"-shaped protrusion whose opening defines a longitudinal clipping recess (51) opening toward or essentially parallel to the base leg (4), the clipping recess (51) being configured to receive the connecting piece (3) with a form-fitting and friction-locking engagement;

wherein, in a coupled state of the system (1), the profiles (2) are coaxially aligned such that their longitudinal ends (21) abut one another, and the connecting piece (3) is simultaneously retained in the clipping recesses (51) of the respective main legs (5) to interconnect the profiles (2).

2. The system according to claim 1, wherein the clipping recess (51) includes undercut recesses (58) that cooperate with complementary projections (34) on the connecting piece (3) to enhance the form-fitting engagement.

3. The system according to claim 1, wherein the connecting piece (3) comprises a body (31) configured to fit in the clipping recess (51), the body (31) having a groove (32) configured to facilitate the insertion of the body (31) in the clipping recess (51).

4. The system according to claim 1, wherein the connecting piece (3) comprises a body (31) configured to fit in the clipping recess (51), the body (31) having a groove (32) configured to facilitate the insertion of the body (31) in the clipping recess (51), and a flange (33) that extends essentially perpendicular from the body (31), wherein, in a coupled state of the system (1), the body (31) is embedded in the clipping recess (51) so as a tile is abutting the flange (33).

5. The system according to claim 1, wherein the connecting piece (3) is made of an elastomeric or thermoplastic material to facilitate elastic compression during insertion into the clipping recess (51).

6. The system according to claim 1, wherein the main leg ("C"-shaped protrusion (50), viewed in cross-section, has an inner wall (52) closest to the base leg (4), an outer wall (53) spaced from the base leg (4), and a boundary wall (54) extending substantially perpendicular to the base leg (4) and interconnecting the inner and outer walls; and wherein the main leg (5) further comprises a spacer flange (55) extending substantially perpendicular to, and integrally joining, the base leg (4) and the "C"-shaped protrusion (50) at the inner wall (52), delimiting the clipping recess (51); and thereby a sealing wall (56) spacing apart the outer wall (53) thereby forming a grout groove (57) between said sealing wall (56) and the outer wall (53).

7. The system according to claim 6, wherein the connecting piece (3) comprises a body (31) configured to fit in the clipping recess (51), the body (31) having a groove (32) configured to facilitate the insertion of the body (31) in the clipping recess (51), wherein, in a coupled state of the system (1), the body (31) is embedded in the clipping recess (51) so as a tile (6) is abutting the spacer flange (55) and/or the end of the outer wall (53) and the grout groove (57) is filled with grout.

8. The system according to claim 6, wherein the connecting piece (3) comprises a body (31) configured to fit in the clipping recess (51), the body (31) having a groove (32) configured to facilitate the insertion of the body (31) in the clipping recess (51), and a flange (33) that extends essentially perpendicular from the body (31) and configured to the abutment of a tile (6), wherein, in a coupled state of the system (1), the body (31) is embedded in the clipping recess (51) so as a tile is abutting the flange (33) and the grout groove (57) is filled with grout.

9. A profile system (1) for finishing tiles that comprises at least two elongate profiles (2), each having a constant cross-section along their length;

an elongated connecting piece (3) having a constant cross-section along its length configured to join the profiles (2);

wherein each elongated profile (2) comprises, viewed in cross-section, a base leg (4) configured for engaging a primary substrate or base, and a main leg (5) adjoining the base leg (4) and comprising:

a generally "C"-shaped protrusion (50) whose opening defines a longitudinal clipping recess (51) opening toward or essentially parallel to the base leg (4), the "C"-shaped protrusion (50) having an inner wall (52) closest to the base leg (4), an outer wall (53) spaced from the base leg (4), and a boundary wall (54) extending substantially perpendicular to the base leg (4) and interconnecting the inner and outer walls, the clipping recess (51) being configured to receive the connecting piece (3) with a form-fitting and friction-locking engagement; and a sealing wall (56) spaced apart from the outer wall (53) and thereby forming a grout groove (57) between said sealing wall (56) and the outer wall (53), the grout groove (57) being configured to cooperate with an edge of an adjacent tile (6) to define a grout joint;

wherein, in a coupled state of the system (1), the profiles (2) are coaxially aligned such that their longitudinal ends (21) abut one another, and the connecting piece (3) is simultaneously retained in the clipping recesses (51) of the respective main legs (5) to interconnect the profiles (2).

10. A profile system (1) for finishing tiles that comprises at least two elongate profiles (2), each having a constant cross-section along their length;

an elongated connecting piece (3) having a constant cross-section along its length configured to join the profiles (2);

wherein each elongated profile (2) comprises, viewed in cross-section, a base leg (4) configured for engaging a primary substrate or base, and a main leg (5) adjoining the base leg (4) and comprising:

a generally "C"-shaped protrusion (50) whose opening defines a longitudinal clipping recess (51) opening toward or essentially parallel to the base leg (4), the "C"-shaped protrusion (50) having an inner wall (52) closest to the base leg (4), an outer wall (53) spaced from the base leg (4), and a boundary wall (54) extending substantially perpendicular to the base leg (4) and interconnecting the inner and outer walls, the clipping recess (51) being configured to receive the connecting piece (3) with a form-fitting and friction-locking engagement;

a spacer flange (55) extending substantially perpendicular to, and integrally joining, the base leg (4) and the "C"-shaped protrusion (50) at the inner wall (52), thereby delimiting the clipping recess (51); and a sealing wall (56) spaced apart from the outer wall (53) and thereby forming a grout groove (57) between said sealing wall (56) and the outer wall (53);

wherein the sealing wall (56) and the grout groove (57) are configured such that a width of a grout joint formed between the sealing wall (56) and an edge of an adjacent tile (6) is selectable within a range of about 1.5 mm to 5 mm; and wherein, in a coupled state of the system (1), the profiles (2) are coaxially aligned such that their longitudinal ends (21) abut one another, and the connecting piece (3) is simultaneously retained in the clipping recesses (51) of the respective main legs (5) to interconnect the profiles (2).

11. The system according to claim 9, wherein the clipping recess (51) includes undercut recesses (58) that cooperate with complementary projections (34) on the connecting piece (3) to enhance the form-fitting engagement.

12. The system according to claim 9, wherein the connecting piece (3) comprises a body (31) configured to fit in the clipping recess (51), the body (31) having a groove (32) configured to facilitate the insertion of the body (31) in the clipping recess (51).

13. The system according to claim 10, wherein the connecting piece (3) is made of an elastomeric or thermoplastic material to facilitate elastic compression during insertion into the clipping recess (51), and comprises a body (31) configured to fit in the clipping recess (51) and a flange (33) that extends essentially perpendicular from the body (31) and configured for the abutment of a tile (6).

* * * * *